US006930287B2

(12) United States Patent
Gerola et al.

(10) Patent No.: US 6,930,287 B2
(45) Date of Patent: Aug. 16, 2005

(54) RANDOM POSITIONING COOKING HOB WITH USER INTERFACE

(75) Inventors: Davide Gerola, Varese (IT); Cristiano Pastore, Borgomanero (IT)

(73) Assignee: Whirlpool Corporation, Bentor Harbor, MI (US)

( * ) Notice: Subject to any disclaimer, the term of this patent is extended or adjusted under 35 U.S.C. 154(b) by 0 days.

(21) Appl. No.: 10/890,739

(22) Filed: Jul. 14, 2004

(65) Prior Publication Data

US 2005/0029245 A1 Feb. 10, 2005

(30) Foreign Application Priority Data

Aug. 4, 2003 (IT) ..... MI20003A1602

(51) Int. Cl.[7] ..... H05B 3/68

(52) U.S. Cl. ..... 219/447.1; 219/446.1; 219/518; 219/506; 219/448.11; 219/448.12; 219/448.13

(58) Field of Search ..... 219/447.1, 518, 219/506, 446.1, 448.11, 448.12, 448.13

(56) References Cited

U.S. PATENT DOCUMENTS 5,097,113 A * 3/1992 Aoyama ..... 219/445.1
5,136,277 A * 8/1992 Civanelli et al. ..... 340/568.1
5,149,944 A * 9/1992 Shimomura ..... 219/445.1
5,658,478 A * 8/1997 Roeschel et al. ..... 219/502
5,893,996 A * 4/1999 Gross et al. ..... 219/447.1
5,900,174 A * 5/1999 Scott ..... 219/447.1
6,259,069 B1 * 7/2001 Schotten et al. ..... 219/447.1

* cited by examiner

*Primary Examiner*—Shawntina Fuqua
(74) *Attorney, Agent, or Firm*—Robert O. Rice; John F. Colligan; Stephen Krefman

(57) ABSTRACT

A cooking hob with random positioning of pans or the like, comprising a plurality of electrical heating elements disposed within a cooking area and individually powered under the control of a control circuit, the heating elements also being used as position sensors for the pan or pans placed on the cooking area, in which a user interface is present, provided with a touch screen reproducing the cooking area and on which, for each pan placed on the cooking area, there is displayed an activatable region substantially representative of the position of the pan on the cooking area, this position being obtained from data provided by the electrical heating elements in their function as position sensors.

6 Claims, 4 Drawing Sheets

RANDOM POSITIONING COOKING HOB WITH USER INTERFACE

BACKGROUND OF THE INVENTION

1. Field of the Invention

The present invention relates to a user interface for cooking hobs with random positioning of pans or the like.

2. Description of the Related Art

Cooking hobs with random positioning are known for example from a patent filed by the same applicant under U.S. patent Ser. No. 10/004,210, now issued as U.S. Pat. No. 6,614,006, which is hereby incorporated reference herein. These cooking hobs present a glass ceramic plate, below which independently powered heating elements (thermal cells) are present. These heating elements are disposed in such a manner as to involve the entire surface of the cooking hob. In collaboration with other means, the heating elements also act as sensors for sensing the position of pans placed on the hob, the data relative to the position of the pans then being stored.

SUMMARY OF THE INVENTION

An object of the present invention is to provide a user interface for cooking hobs with random positioning which enables the user to regulate for each individual pan the thermal power of those heating elements relative to the pan or pans present on the cooking hob, and also the energy supplied with time.

A further object of the present invention is to provide a relatively economical user interface of simple, intuitive and immediate utilization.

These and other objects are attained by a user interface for cooking hobs with random positioning in accordance with the teachings of the accompanying claims.

BRIEF DESCRIPTION OF THE DRAWINGS

Further characteristics and advantages of the invention will be more apparent from the description of a preferred but non-exclusive embodiment of the user interface for a cooking hob with random positioning illustrated by way of non-limiting example in the accompanying drawings, in which.

DETAILED DESCRIPTION

The figures show a cooking hob indicated overall by 1 and comprising a glass ceramic plate 2 forming a cooking area 3, below which independent heating elements 4, substantially in the form of electrical resistance elements, are present. These heating elements can be activated or deactivated independently.

Figure 2:
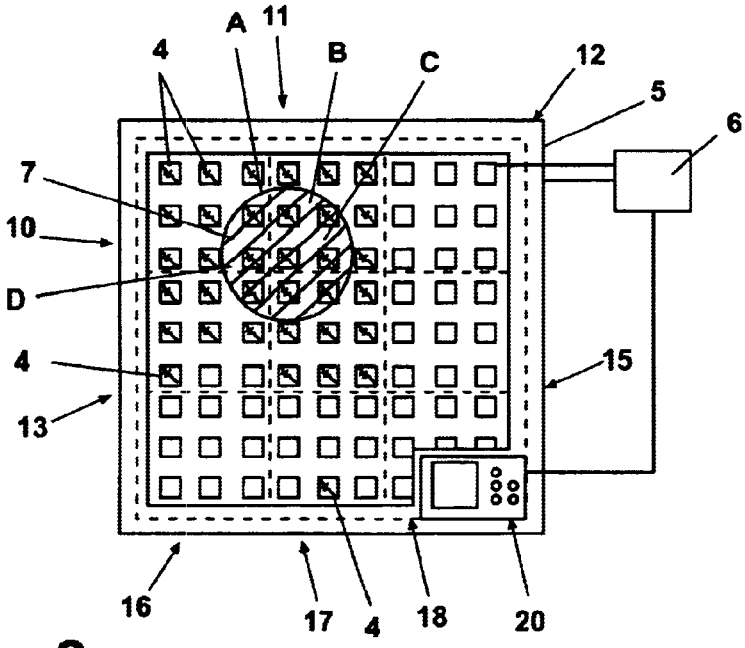
FIG. 2 is a schematic view of a detail of a cooking hob with random positioning.

The heating elements are used not only to cook or heat the food contained in the pan, but also to identify the position of the overlying pan. The data identifying this position are then stored. When a pan 7 is disposed in any position on the cooking hob, its position is identified, with consequent determination of which heating elements 4 lie below said pan (the elements A, B, C, D in the case of FIG. 2), this information then being stored in the memory of an electronic control circuit 6 (which also controls the power supply to the elements). Only these elements A, B, C, D will be the heating elements 4 to be activated when heat is to be fed to the pan 7 and hence to its contents. In a real situation the heating elements could be in a much greater number than that shown by way of example in the drawings for reasons of clarity.

In one embodiment the user interface 20 comprises a screen 21 and icons 41, 42, 43, 44 positioned to the side of said screen 21.

Below each icon there is positioned a proximity sensor (for example of the known capacitive type, not shown) the output of which is connected to the control circuit 6. Rubbing or touching an icon with a finger changes the output of the corresponding sensor, this change being read by the control circuit 6. The function of these icons is described in detail hereinafter.

Figure 3:
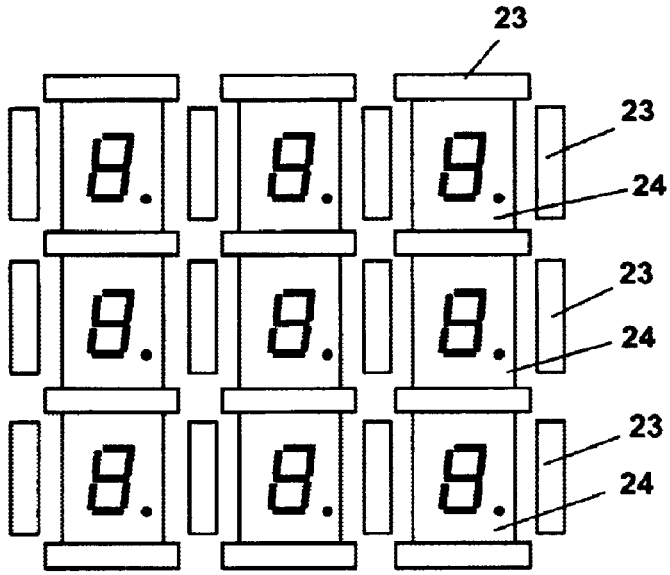
FIG. 3 is a schematic view of a detail of the user interface of the present invention.
Figure 4:
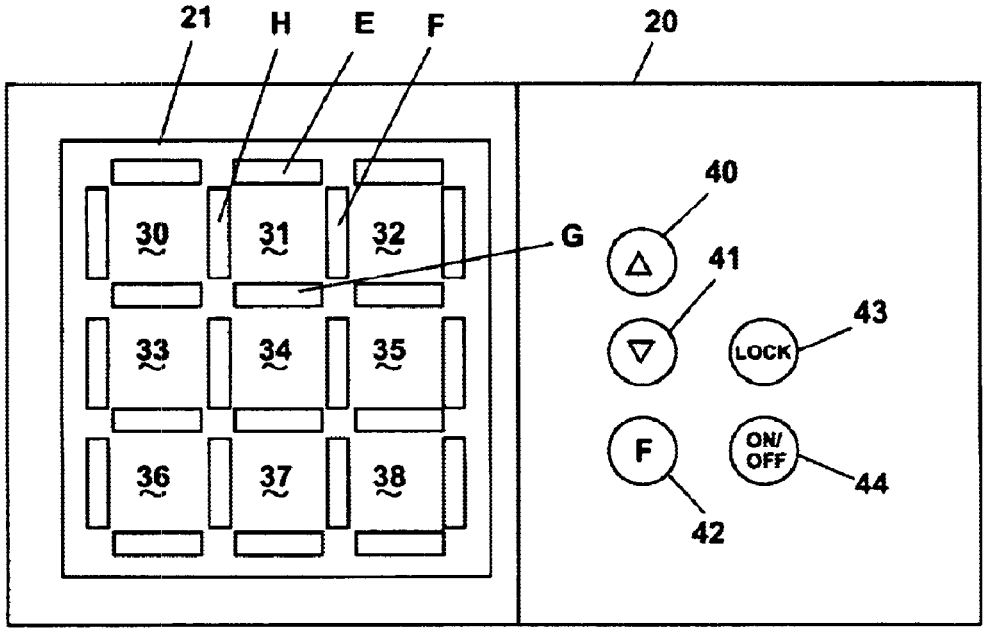
FIG. 4 is an enlarged view of a user interface of the present invention.

The screen 21 (see FIG. 3 in particular) comprises linear light emitting diodes (LEDs) 23 (twenty-four in number in the example), disposed to define nine visual regions 30–38, each provided with a numerical indicator integrating a capacitive sensor 24 (for example those produced by the EGO Company) situated side by side in an arrangement resembling the shape of the cooking area 3, as shown in FIG. 4. In the illustrated example, the visual regions 30–38 are substantially square and are made to correspond to effective regions 10–18 on the cooking area 3, for example by means of a processing algorithm. In the example, these effective regions 10–18 comprise groups each of nine heating elements 4.

Essentially (FIG. 2) the control circuit 6 reads from its memory which elements lie directly below the pan 7 (A, B, C, D in the example) and determines to which of the effective regions (10–18) they pertain, namely the effective region 11 in the example. If the pan 7 is of larger dimensions and totally or partially occupies more than one effective region (10–18), that sector which best approximates to the real configuration of the powered elements below the pan is displayed on the display. Said control circuit 6 then powers those linear LEDs 23 defining the visual region 31 corresponding to the best approximation of the pan and of the powered elements below them (A, B, C, D in the example, hence it powers the diodes E, F, G, H, approximately defining the visual region 31 corresponding to the effective region 11). There is hence an immediate representation on the screen 21 of the position of the pan 7 on the cooking area 3.

Figure 5:
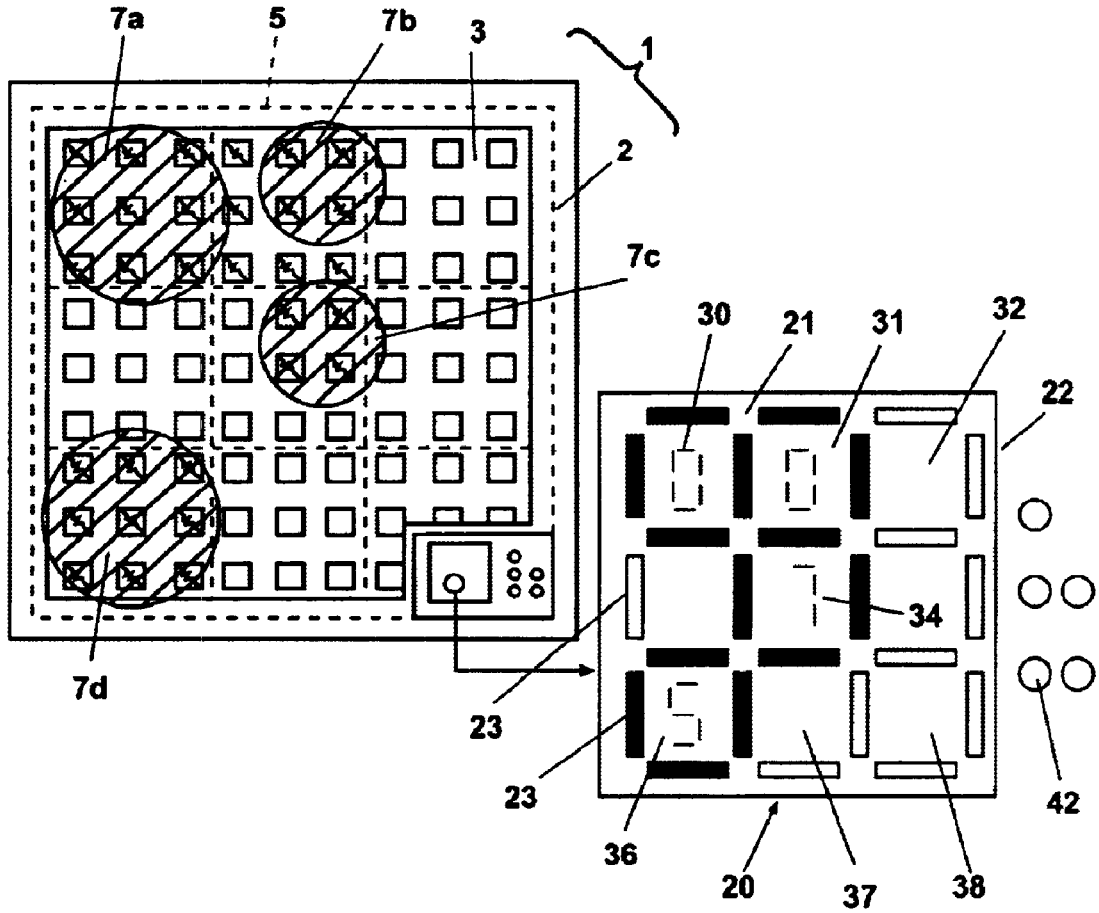
FIG. 5 is a schematic plan view of a random positioning cooking hob provided with a user interface and with four pans disposed thereon, with some details enlarged.

In the example of FIG. 5, several pans 7*a, b, c, d* are simultaneously present on the cooking hob 4. In this example the visual regions displayed are the regions 30, 31, 34 and 36 which approximate to those regions in which the heating elements are effectively involved.

With the visual region corresponding to that portion occupied by a pan 7 displayed on the user interface 20, the control circuit 6 lights the numerical indicator incorporating a capacitive sensor 24 present in the visual region itself and sets the indicated value to zero. This means that those heating elements 4 positioned below the pan do not provide heat thereto.

The user hence has a direct representation both of the position of the pan 7 and of the power provided by those heating elements 4 acting below it, this power being associated with a number shown on the numerical indicator 24 which corresponds to the effective region 11 in which the pan 7 is positioned.

Figure 1:
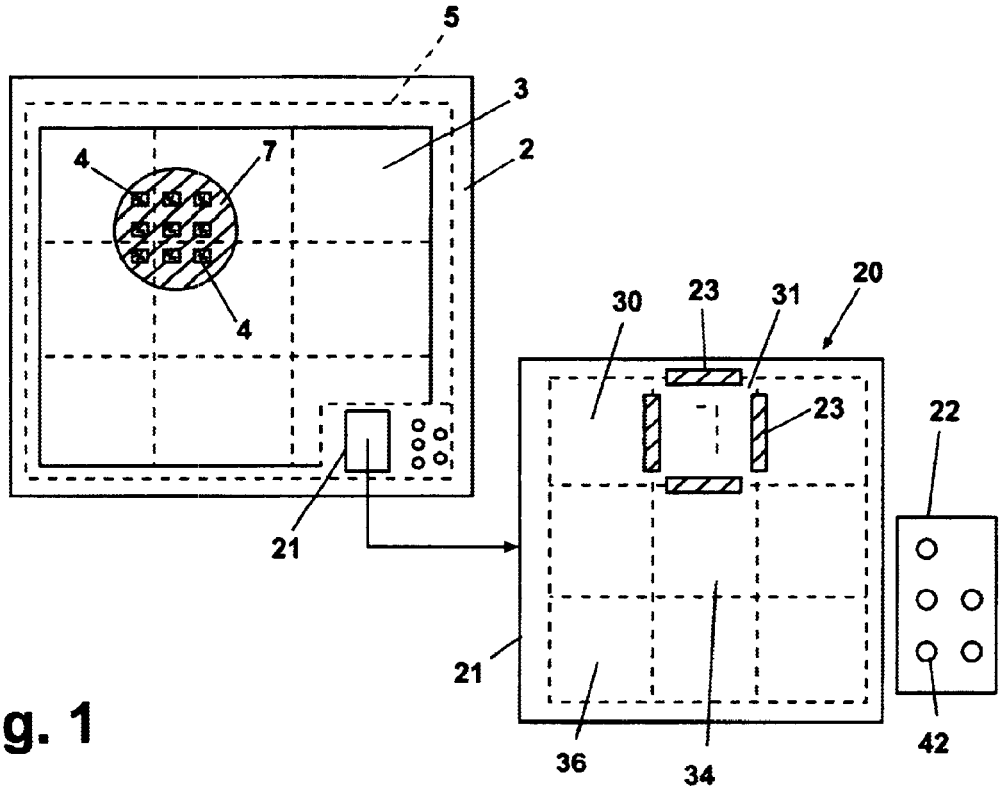
FIG. 1 is a schematic plan view of a cooking hob with random positioning provided with the user interface and showing a pan disposed thereon, with some details enlarged.

The user can substantially regulate this power by touching that visual region (for example the region 31) corresponding to the position of the chosen pan 7, in order to select it. This selection is achieved by changing the output, read by the control circuit 6, of the capacitive sensor incorporated in the numerical indicator 24 of the touched visual region. Having thus selected the pan 7, the user skims the icon 40 or 41 (upward/downward arrow) to cause the control circuit 6 to increase/decrease the power of the heating elements 4 below the pan 7, so increasing/decreasing the value shown by the numerical indicator present in the corresponding visual region (in the example shown in FIG. 1, the value is seven, skimming the icon causing the value to pass to 8, with a corresponding increase in the power fed to the pan; skimming the icon 41 changes the value shown to six and so on).

Skimming the icon 42 allows cooking functions to be selected, skimming the key 43 blocks the use of the interface (for example by children), while skimming the key 44 activates/deactivates the interface. All these functions are controlled by the control circuit 6.

As already stated, the heating elements 4 of which the power is regulated by the interface of the invention are always and only those present below the pan 7.

Figure 6:
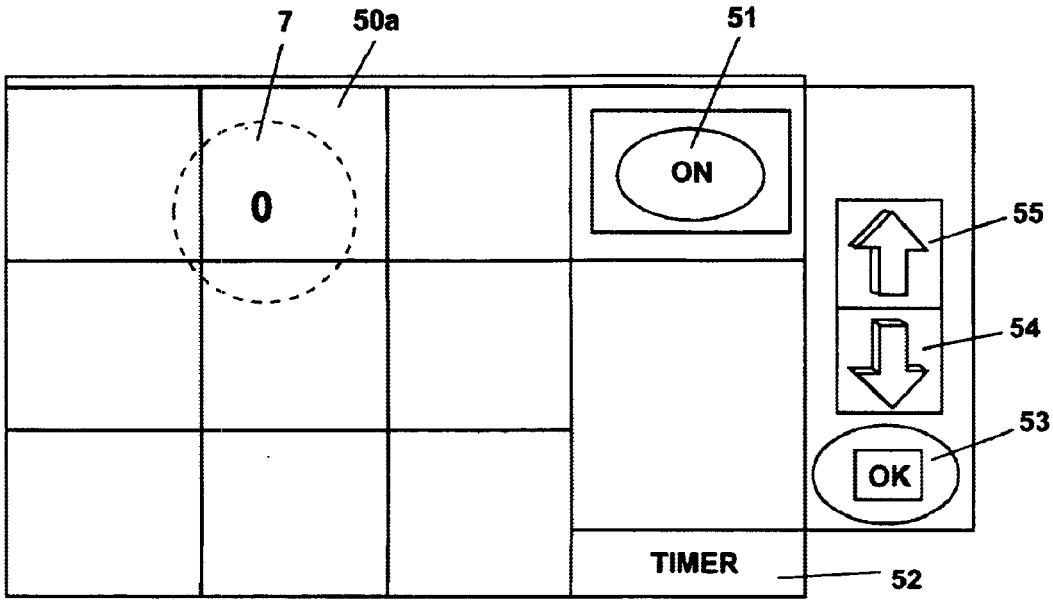
FIG. 6 is a plan view of a different embodiment of a user interface according to the present invention.

The user interface can take different forms; for example FIG. 6 shows a different embodiment. In this case the user interface consists of a touch screen 50. showing in a first part 50*a* the cooking area 3, and in a second part the keys (or icons), including an ON/OFF key 51, a timer key 52, an OK key 53, a downward arrow key 54 and an upward arrow key 55.

On placing (FIGS. 6, 7) a pan 7 on the cooking area 3, its position is displayed, no longer approximately, on that part 50*a* representing the cooking area of the user interface. The position is shown by an outline 56 representing the position and shape of the pan on the cooking area. This position is identified by the control circuit 6, which from the memory reads which heating elements 4 lie below the pan, defining their position and number in a manner such as to be able to approximate very accurately to the position and shape of the pan, and display it on the touch screen. As in the preceding embodiment, within the outline 56 there is a number indicating the power with which the heating elements 4 below the pan are supplied. This is regulated by touching a point within the outline of the pan shown on the screen followed by touching one or other of the arrows 54, 55 to decrease/increase the thermal power which, as in the previous case, is supplied only to those heating elements 4 below the pan.

Figure 7:
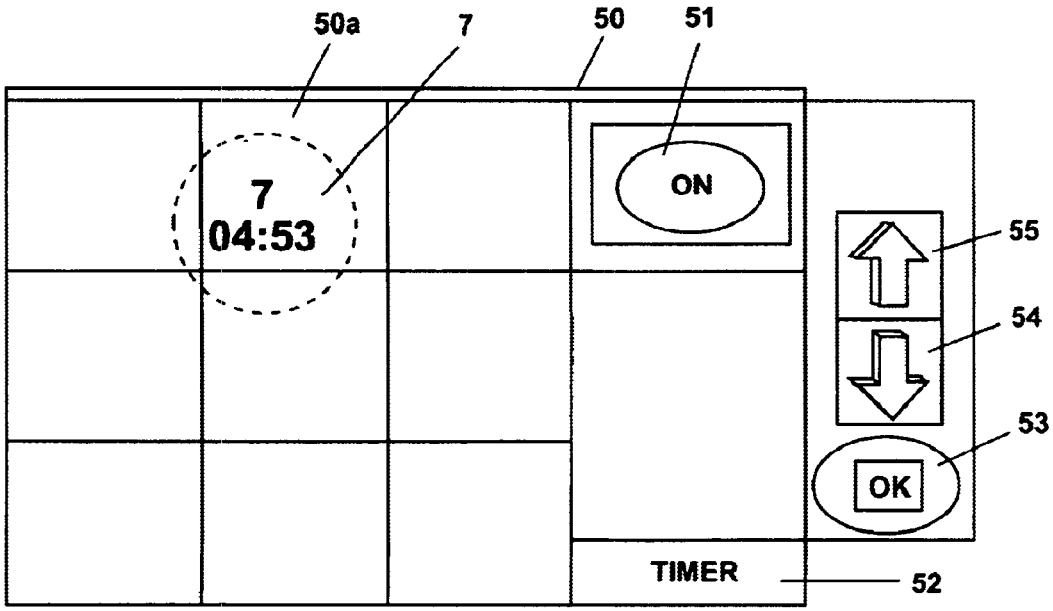
FIG. 7 is another view of the interface of FIG. 6.

In FIG. 7 the pan is shown on the touch screen with power at seven and cooking time at 4:53 minutes. The number indicates the time after which cooking will terminate. This time is set by touching the outline 56 representing the pan and the timer key 52, then adjusting it by touching the arrows 54, 55. The cooking time is controlled by the control circuit 6, in known manner.

Two preferred embodiments have been illustrated, however others can be devised using the same inventive concept.

We claim:

1. A cooking hob having a plurality of electrical heating elements disposed within a cooking area and individually powered under the control of a control circuit, the heating elements also being used as position sensors for the pan or pans placed on the cooking area, the cooking hob comprising a user interface provided with a touch screen reproducing the cooking area and on which, for each pan placed on the cooking area, there is displayed an activatable region substantially representative of the position of the pan on the cooking area, this position being obtained from data provided by the electrical heating elements in their function as position sensors.

2. A cooking hob as claimed in claim 1, wherein the user interface presents sensor means for setting the cooking parameters, such as heating power, cooking cycle, cooking duration and the like, the cooking parameters being set after activating that activatable region substantially representative of the pan position.

3. A cooking hob as claimed in claim 2, wherein the activatable region is activated by touching or skimming.

4. A cooking hob as claimed in claim 3, wherein the touch screen is divided into a discrete number of activatable regions defined by linear light emitting diodes and including position sensors associated with numerical indicators, each of said activatable regions corresponding, by means of a processing algorithm, to an assigned group of electrical heating elements of the cooking area, the heating elements being assigned to a pan by the control circuit.

5. A cooking hob as claimed in at least one of claim 3, wherein the activatable region reproduces at least approximately the form of the pan on the touch screen.

6. A cooking hob as claimed in claim 5, wherein data relative to the set functional parameters, such as thermal power provided by the resistive heating elements, cooking times and cycles, can visually appear in the interior of the reproduced shape of the pan.

* * * * *